US007958930B2

(12) United States Patent
Fehlemann et al.

(10) Patent No.: US 7,958,930 B2
(45) Date of Patent: Jun. 14, 2011

(54) WALL OF A CASTING DIE FOR CASTING A MOLTEN METAL

(75) Inventors: Gereon Fehlemann, Düsseldorf (DE); Albrecht Girgensohn, Düsseldorf (DE); Jörn Hoffmeister, Moers (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 119 days.

(21) Appl. No.: 12/448,999

(22) PCT Filed: Dec. 11, 2007

(86) PCT No.: PCT/EP2007/010770

§ 371 (c)(1),
(2), (4) Date: Aug. 28, 2009

(87) PCT Pub. No.: WO2008/086853

PCT Pub. Date: Jul. 24, 2008

(65) Prior Publication Data

US 2010/0000701 A1 Jan. 7, 2010

(30) Foreign Application Priority Data

Jan. 18, 2007 (DE) ..... 10 2007 002 804

(51) Int. Cl.
*B22D 11/04* (2006.01)
*B22D 11/124* (2006.01)

(52) U.S. Cl. ..... 164/418; 164/443

(58) Field of Classification Search ..... 164/443, 164/418, 459

See application file for complete search history.

(56) References Cited

U.S. PATENT DOCUMENTS

| | | | | |
|---|---|---|---|---|
| 3,473,601 | A * | 10/1969 | Pfenning | 164/435 |
| 3,978,910 | A | 9/1976 | Gladwin | |
| 5,470,012 | A * | 11/1995 | Linse et al. | 228/107 |
| 6,145,579 | A * | 11/2000 | Stagge et al. | 164/418 |
| 6,289,970 | B1 * | 9/2001 | Fehlemann | 164/443 |
| 6,874,564 | B2 * | 4/2005 | Hugenschutt et al. | 164/418 |
| 7,234,508 | B2 * | 6/2007 | Vestman et al. | 164/418 |

FOREIGN PATENT DOCUMENTS

| | | |
|---|---|---|
| DE | 196 39 295 | 3/1998 |
| DE | 199 03 929 | 8/2000 |
| DE | 202007000778 | 3/2007 |
| EP | 1 555 073 | 7/2005 |
| JP | 2006/284503 | 10/2006 |
| WO | 02/07915 | 1/2002 |

* cited by examiner

*Primary Examiner* — Kevin P Kerns
(74) *Attorney, Agent, or Firm* — Lucas & Mercanti, LLP; Klaus P. Stoffel

(57) ABSTRACT

The invention relates to a wall (100) of a casting die for casting a molten metal. Die walls comprising a front plate (110) with a pocket borehole (112) and a rear plate (120) with a transversal borehole (122) aligned with the pocket borehole, on the cold side of the die front plate, are known in prior art. The aim of the invention is prevent the entrance of cooling liquid from the transition region (115), between the front plate (110) and the rear plate (120), into the pocket borehole (112) or the transversal borehole (122). To this end, a sealing element (140) having a longitudinal borehole is arranged in the transition region (115) in such a way that the longitudinal borehole of the sealing element is at least approximately aligned with the transversal borehole (122) in the rear plate of the die and the pocket borehole (112) in the front plate of the die.

10 Claims, 3 Drawing Sheets

WALL OF A CASTING DIE FOR CASTING A MOLTEN METAL

The invention concerns the wall of a casting die for casting molten metal.

Casting dies with casting die walls are basically well known in the prior art. The hot sides of the walls of the casting die that face the molten metal define a space for the initially still molten metal and at the same time predetermine the shape of the later solidified metal.

On the one hand, casting die walls are known that are constructed as a single piece and consist essentially only of one casting die plate. The cold side of the casting die plate is typically bolted with bolt elements onto a water tank for cooling the casting die plate during the casting operation. In casting die walls of this design, it is well known that some of the bolt elements have a longitudinal borehole, through which a thermocouple is guided into a blind borehole in the casting die plate that is aligned with the longitudinal borehole. The thermocouple then makes it possible to detect and monitor the temperature of the casting die plate during the casting operation.

Besides casting die walls that are constructed as a single piece, there are also casting die walls constructed as two pieces, which have not only a casting die front plate but also a casting die rear plate, which we shall also refer to as an adapter plate. The front plate of the casting die has a hot side that faces the molten metal and a cold side that faces away from the molten metal. In two-piece casting die wall designs, the rear plate of the casting die is bolted onto the cold side of the front plate of the casting die. Cooling channels or boreholes, through which cooling liquid flows at high pressure and a high flow rate to cool the casting die, are usually located in the area of the plane that separates the two plates. Alternatively, it is also possible to realize practically full-surface cooling. In this two-piece construction, the front plate of the casting die is typically made of copper, and the rear plate of the casting die is typically made of a different, less expensive and possibly more stable material than copper, e.g., steel. In this way, costs can be reduced, and at the same time the strength of the casting die wall can be increased. Finally, it is also well known that the rear plate of the casting die, together with the front plate of the casting die, can be bolted onto a water tank by means of bolt elements.

Japanese Patent Application JP 2006 28 45 03 discloses the attachment of a thermocouple in a blind borehole on the cold side of a casting die plate.

International Patent Application WO 02/07915 A1 discloses a continuous casting die with copper plates enclosing the continuous casting cross section. Cooling channels that run in the copper plates are fed by a water tank, which is bolted on the casting die plates on the cold side of the plates. The water tank is bolted to the cold side of the casting die plate with fastening bolts, which are screwed through an adapter into the cold side of the casting die plate. A seal in the form of a sealing ring is provided on the end face of the adapter, which presses against the cold side of the casting die plate. At the same time, this sealing ring is thus also located in the transition region between the cold side of the casting die and the wall of the water tank or the rear plate of the casting die.

Taking this prior art as a point of departure, it is the objective of the invention, in a basically well-known casting die wall constructed from a casting die front plate and a casting die rear plate, to prevent the entrance of cooling liquid from a transition region between the front plate and the rear plate of the casting die into a blind borehole in the front plate of the casting die and into a transverse borehole in the rear plate of the casting die that is at least approximately aligned with the blind borehole, even in the event of transverse movements between the front plate of the casting die and the rear plate of the casting die.

This objective is achieved by the object of claim 1, which is characterized by the fact that the tubular sealing element is designed with the shape of a dog bone with a bulge in its two end regions, such that, in its installed state, the bulge at one end is inserted in the blind borehole in the front plate of the casting die, and the bulge at the other end is inserted in the transverse borehole in the rear plate of the casting die.

The sealing element prevents cooling liquid, which is present under high pressure in the cooling channels and thus in the transition region between the front plate and the rear plate of the casting die, from being able to penetrate the blind borehole in the front plate of the casting die and the transverse borehole in the rear plate of the casting die, which are sealed by the sealing element.

Because dynamic transverse forces or transverse movements that arise between the front plate of the casting die and the rear plate of the casting die during the operation of the casting die cannot be avoided in practice, it has been found to be advantageous if the sealing element is constructed in such a way that it takes into account the transverse movement, i.e., the relative movement between the front plate of the casting die and the adapter plate. In accordance with the invention, this design of the sealing element is achieved by providing the sealing element with a significantly smaller outside diameter in the transition region or, more precisely, especially at the level of the plane that separates the front plate of the casting die and the rear plate of the casting die, than in its end regions (including any sealing rings that may be present there), which extend into the possibly locally widened inside diameters of the blind borehole and transverse borehole.

In a further embodiment of this type, the sealing element can be designed, e.g., in the form of a tube, whose outside diameter is smaller than the inside diameters of the possibly locally widened blind borehole and transverse borehole. Due to the difference between the diameters, sufficient play and freedom of movement is left for the sealing element, so that the transverse movements can occur unhindered without any damage to the sealing element. The difference between the diameters is sealed by means of sealing media, e.g., O rings, in the end regions of the tubular sealing element.

The transverse movements are taken into consideration especially well by a tubular sealing element whose outer contour is narrowed in the middle, e.g., in the shape of a dog bone.

Sealing media or rings on the ring-shaped bulges of this type of sealing element with the shape of a dog bone guarantee sealing of the blind borehole and the transverse borehole from the cooling liquid from the transition region, even when the transverse forces cause skewing or obliquity of the sealing element in the blind borehole or transverse borehole.

It has been found to be optimal if the sealing element, especially the dog-bone-shaped sealing element, is made, if possible, completely of a rubber-like material. This has the advantage that the transverse forces can then be absorbed especially well by temporary deformation without any danger of destruction or loss of sealing function of the sealing element. If the outside diameters of the sealing element are slightly oversized relative to the possibly locally widened inside diameters of the blind borehole and/or transverse borehole, the sealing element can be inserted in the blind borehole and transverse borehole with a sealing interference fit due to the fact that it consists of a rubber-like material.

If the rear plate of the casting die, whether in the form of an adapter plate or in the form of a wall of a water tank, and the front plate of the casting die, which is joined with the rear plate of the casting die, are bolted onto a/the water tank by fastening bolts, the sealing element of the invention also advantageously prevents cooling liquid from flowing through the blind borehole and/or the transverse borehole into a longitudinal borehole in the fastening bolt that is aligned with these boreholes and leaking out on the rear side of the water tank.

A temperature sensor can be guided from the rear side of the water tank, through the longitudinal borehole in the fastening bolt, and into the blind borehole in the front plate of the casting die. In these cases, the sealing element of the invention has the advantageous effect that the blind borehole and thus the temperature sensor as well stay dry, so that the results of a temperature measurement are not distorted by accumulated moisture.

It is advantageous if suitably sealed temperature sensors are installed not only in one location in the front plate of the casting die but rather are distributed both in the casting direction and in the direction transverse to the casting direction (direction of the slab width) in a plurality of locations. This has the advantage that not only a singular temperature can be determined, but rather the temperature distribution in the front plate of the casting die can be determined at a given time, especially during the casting operation. The temperature distribution determined in this way and especially the temperature gradient in the casting direction provide the advantage that it becomes possible to draw a conclusion about possible adhesion of the melt to the hot side of the front plate of the casting die.

It is advantageous if the end face of the bolt element that faces the rear plate of the casting die has an end-face sealing ring to prevent the penetration of cooling liquid from the water tank, through the transition region between the bolt element and the rear plate of the casting die, and into the transverse borehole of the rear plate of the casting die or, in the other direction, from the transverse borehole into the water tank.

Further advantageous refinements of the casting die wall, the sealing element and the temperature sensor are the objects of the dependent claims.

The specification is accompanied by three figures.

The invention will now be described in detail with reference to the specific embodiments illustrated in the drawings. In all of the figures, technical elements that are the same are labeled with the same reference numbers.

Figure 1:
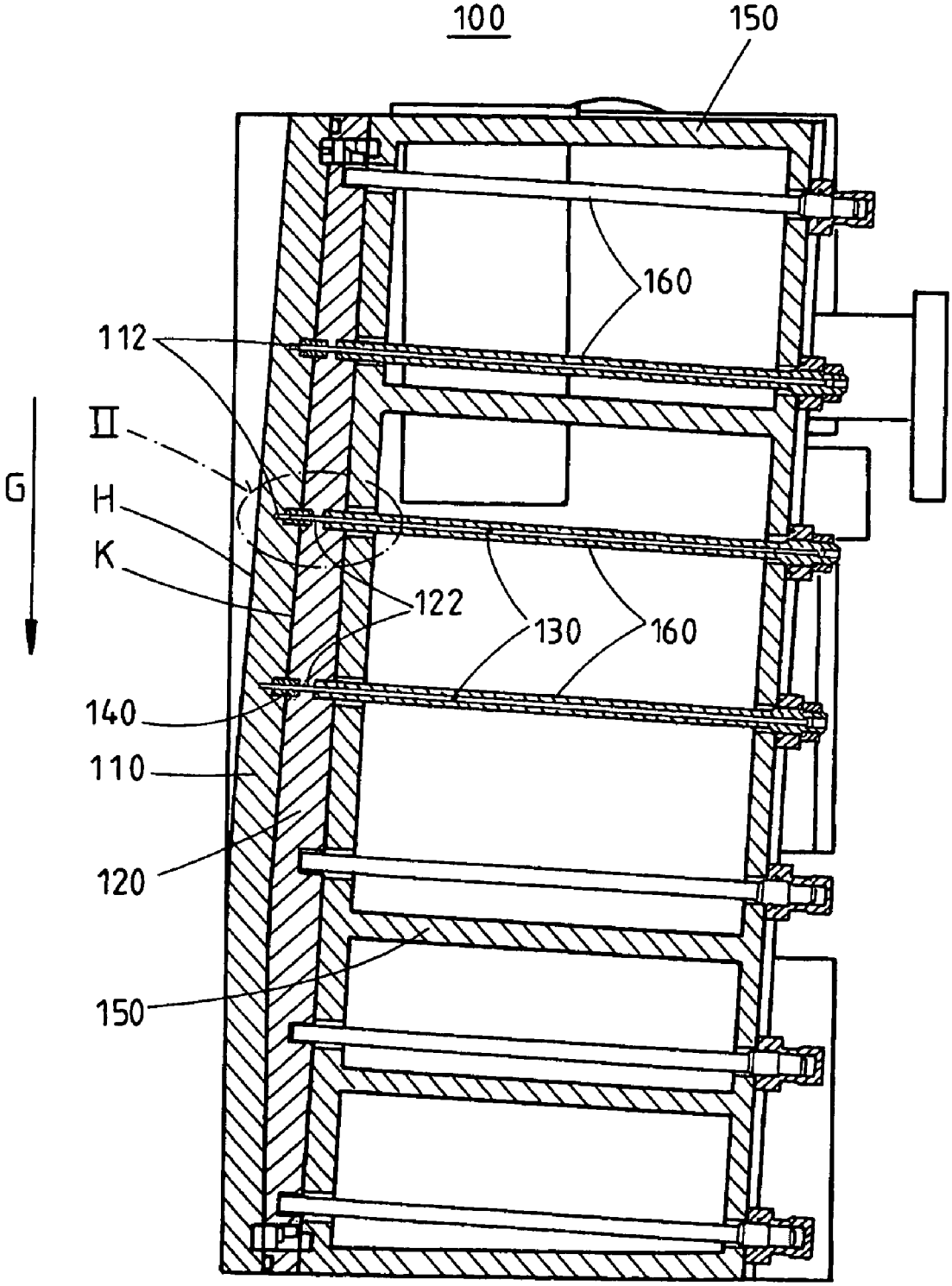
FIG. 1 shows a cross section through a first embodiment of a casting die wall of the invention, in which the rear plate of the casting die is designed as an adapter plate.

FIG. 1 shows a cross section through a first embodiment of the invention, specifically, a casting die wall 100 of a casting die for casting a molten metal (not shown). The casting die wall 100 comprises a casting die front plate 110 with a hot side H that faces the molten metal and a cold side K that faces away from the molten metal. In addition, the casting die wall 100 comprises a casting die rear plate in the form of an adapter plate 120 for supporting the front plate of the casting die. The adapter plate 120 is bolted onto the cold side K of the front plate 110 of the casting die. Cooling channels or boreholes, through which cooling liquid flows at high pressure and a high flow rate to cool the casting die, are usually located between the front plate of the casting die and the adapter plate.

FIG. 1 also shows that the casting die wall 100 is associated with a water tank 150, which supplies the cooling liquid for the cooling channels of the casting die during the casting operation. The side of the adapter plate 120 that faces away from the casting die front plate 110 together with the casting die front plate is bolted to the water tank 150 by bolt elements 160.

Figure 2:
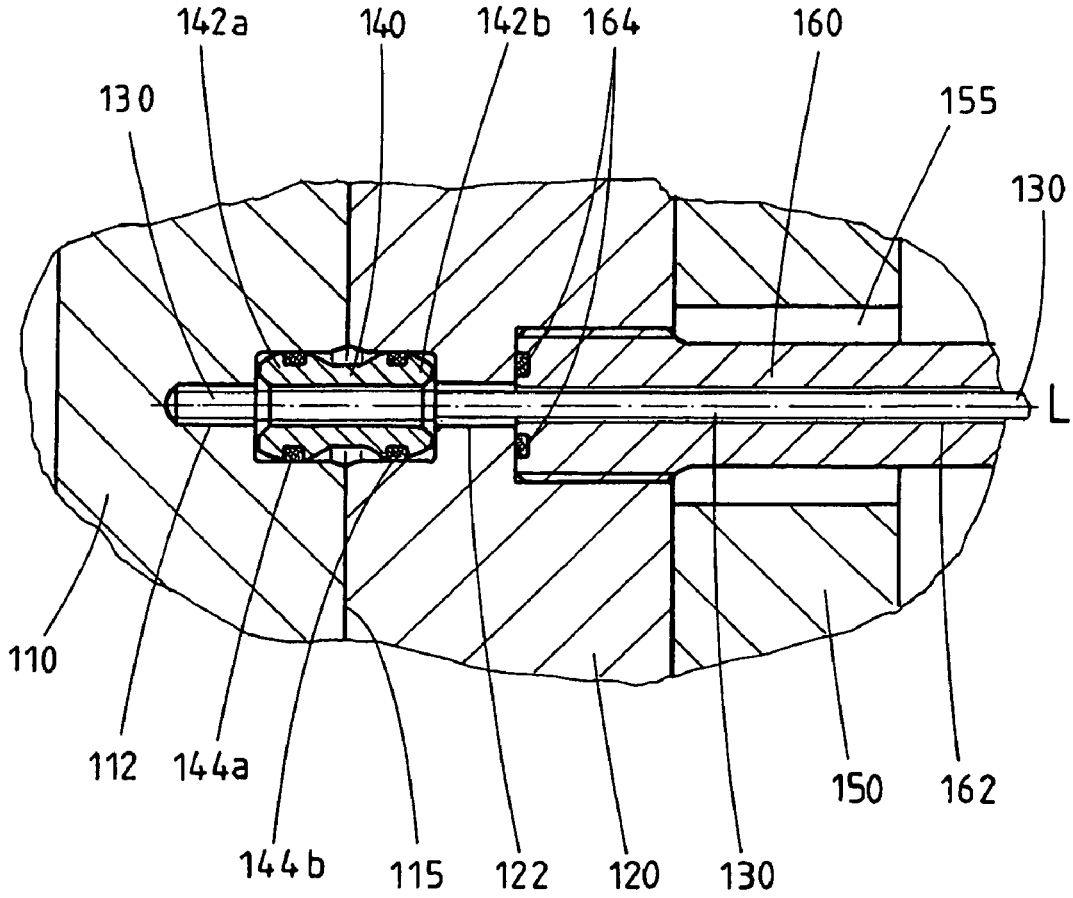
FIG. 2 shows an enlarged segment (II) of FIG. 1.

FIG. 2 shows the aforementioned connection of the water tank 150, casting die rear plate 120 and casting die front plate 110 in detail. The drawing shows that the bolt element 160, which joins the water tank with the casting die rear plate 120, has a longitudinal borehole 162, which is aligned at least approximately with a transverse borehole 122 in the adapter plate 120 and with a blind borehole 112 in the front plate 110 of the casting die. This makes it possible to pass a temperature sensor 130 through the water tank and the adapter plate and into the blind borehole in the front plate 110 of the casting die in order to determine the temperature there, especially during a casting operation. The temperature sensor 130 is preferably designed as a thermocouple.

Due to the cooling channels present in the transition region between the front plate and the rear plate of the casting die, there is the danger that cooling liquid will be forced from the transition region into the longitudinal borehole 162, the transverse borehole 122 or the blind borehole 112. In accordance with the invention, to prevent this, a sealing element 140 is provided in the transition region 115 between the rear plate 120 of the casting die and the front plate 110 of the casting die.

The sealing element 140 has a longitudinal borehole and is mounted in the transition region in such a way that its longitudinal borehole is aligned with the blind borehole 112 and the transverse borehole 122. When a temperature sensor is passed through the bolt element 160 into the blind borehole 112, the sealing element 140 locally encloses the temperature sensor 130.

FIG. 2 shows a preferred embodiment of this sealing element, in which the sealing element 140 with the longitudinal borehole is formed with rotational symmetry in the form of a dog bone with a bulge 142*a*, 142*b* in each of its two end regions. One of the bulges 142*a* is located at the end of the sealing element that is inserted in the locally widened blind borehole 112 in the front plate 110 of the casting die. The mirror-image bulge 142*b* at the other end of the sealing element 140 is inserted in the widened transverse borehole 122 in the adapter plate 120. Peripheral sealing rings 144*a*, 144*b* are mounted on the surface of the two bulges 142*a*, 142*b* in a plane perpendicular to the longitudinal direction L of the dog bone. Their purpose, roughly speaking, is to seal the rear plate 120 of the casting die from the front plate 110 of the casting die. To be more precise, the sealing ring 144*a* prevents liquid from the transition region 115 between the rear plate 120 and the front plate 110 of the casting die from penetrating into the more deeply situated regions of the blind borehole 112 inside the front plate of the casting die. On the other hand, the sealing ring 144*b* prevents liquid from the transition region 115 from penetrating especially into the unwidened region of the transverse borehole 122.

Alternatively, the sealing element 140, including the sealing rings 144*a*, 144*b*, can be formed as a single piece of rubber-like material, and the separate sealing rings can then be dispensed with.

It is also advantageous that the end-face sealing ring 164 on the end face of the bolt element 160 prevents liquid from the transition region 155 between the water tank 150 and the adapter plate 120 from penetrating into the longitudinal borehole 162 or the transverse borehole 122 or in the opposite direction.

The casting die wall described here is preferably a wall of the broad side of a casting die.

Figure 3:
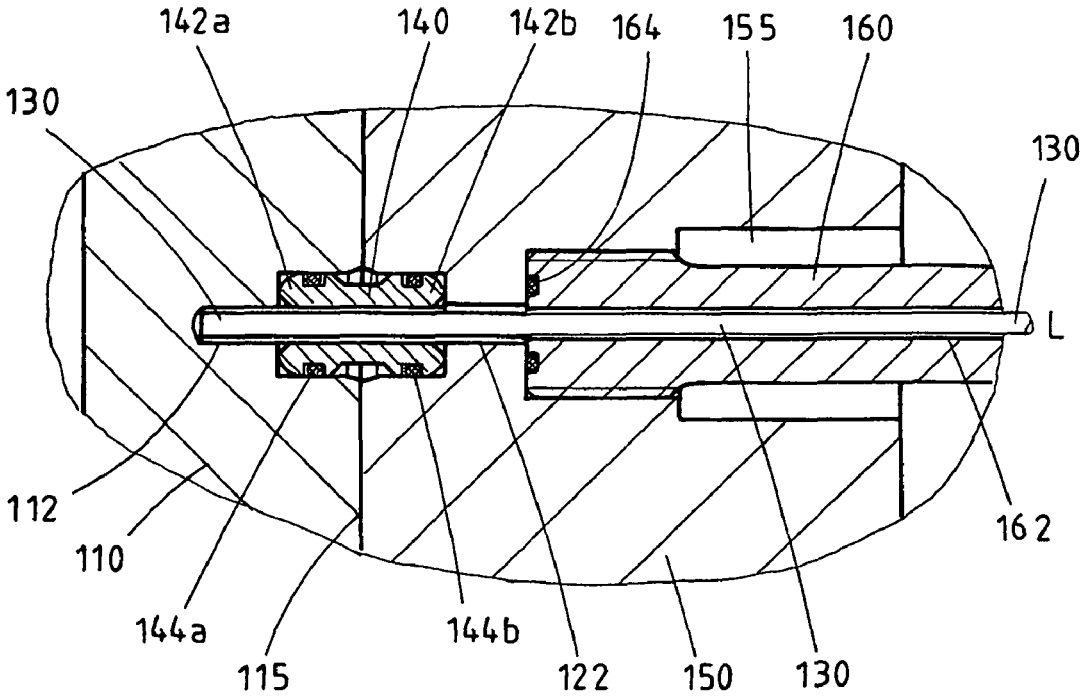
FIG. 3 shows a cross section through a second embodiment of the casting die wall of the invention, in which the casting die wall is identical with a wall of the water tank.

FIG. 3 shows a second embodiment of the casting die wall of the invention. In contrast to the first embodiment, the rear plate of the casting die is not designed in the form of an adapter plate 120 but rather in the form of a wall 150 of the water tank. Otherwise, the above details of the first embodiment apply analogously to the second embodiment shown here.

The invention claimed is:

1. A casting die wall (100) of a casting die for casting a molten metal, which comprises:

a casting die front plate (110) with a hot side (H) that faces the molten metal, a cold side (K) that faces away from the molten metal, and at least one blind borehole (112) on the cold side (K);

a casting die rear plate (120) with at least one transverse borehole (122), such that the casting die rear plate (120) is joined with the casting die front plate (110) on the cold side (K) of the casting die front plate (110) in such a way that the transverse borehole (122) is at least approximately aligned with the blind borehole (112); and a sealing element (140) with a longitudinal borehole, such that the sealing element (140) is arranged in such a way in the transition region (115) between the casting die front plate (110) and the casting die rear plate (120) that the longitudinal borehole is at least approximately aligned with the transverse borehole (122) and the blind borehole (112), wherein the tubular sealing element is designed with the shape of a dog bone with a bulge (142*a*, 142*b*) in its two end regions, such that, in its installed state, the bulge (142*a*) at one end is inserted in the blind borehole (112) in the front plate (110) of the casting die, and the bulge (142*b*) at the other end is inserted in the transverse borehole (122) in the rear plate (120) of the casting die.

2. A casting die wall (100) in accordance with claim 1, wherein each of the two end regions of the sealing element (140), preferably, if applicable, in the region of the greatest diameter of each bulge, has a sealing medium, e.g., in the form of a sealing ring (144*a*, 144*b*), such that the sealing media rest against and seal the installed sealing element and the inner walls of the blind borehole and the transverse borehole.

3. A casting die wall (100) in accordance with claim 1, wherein the sealing element (140) preferably consists entirely of a rubber-like material and that its greatest outside diameters, especially, if applicable, in the region of the bulges, are dimensioned slightly larger than the inside diameters of the blind borehole and the transverse borehole.

4. A casting die wall (100) in accordance with claim 1, wherein the rear plate of the casting die is designed as an adapter plate;

a water tank is provided; and at least one bolt element (160) is provided for fastening the adapter plate (120) and the front plate of the casting die, with which it is joined, to the water tank.

5. A casting die wall (100) in accordance with claim 4, wherein the bolt element (160) is passed through the water tank (150) and has a longitudinal borehole (162), which passes all the way through it and is aligned with the transverse borehole (122) in the rear plate (120) of the casting die and the blind borehole (112) in the front plate (110) of the casting die, for passing a temperature sensor (130) through from the water tank (150) to the blind borehole (112).

6. A casting die wall (100) in accordance with claim 5, wherein at least in the casting direction (G) and preferably transversely to the casting direction as well, a plurality of fastening bolts is provided, each of which has a temperature sensor passed through its longitudinal borehole, for determining the temperature at various points in the front plate of the casting die wall.

7. A casting die wall (100) in accordance with claim 5, wherein the temperature sensor (130) is realized as a thermocouple.

8. A casting die wall (100) in accordance with claim 4, wherein the end face of the bolt element (160) that faces the rear plate (120) of the casting die has an end-face sealing ring (164).

9. A casting die wall (100) in accordance with claim 1, wherein a water tank is provided;

the rear plate of the casting die is identical with a wall (150) of the water tank; and at least one bolt element (160) is provided for fastening the front plate of the casting die to the water tank.

10. A casting die wall (100) in accordance with claim 1, wherein the casting die wall (100) is preferably a wall of the broad side of the casting die.

* * * * *